US007187302B2

(12) United States Patent
Dalgleish

(10) Patent No.: US 7,187,302 B2
(45) Date of Patent: Mar. 6, 2007

(54) ASSESSING THE ACCURACY OF ROAD-SIDE SYSTEMS

(75) Inventor: Michael John Dalgleish, Bicester (GB)

(73) Assignee: Golden River Traffic Limited, Bicester (GB)

( * ) Notice: Subject to any disclaimer, the term of this patent is extended or adjusted under 35 U.S.C. 154(b) by 187 days.

(21) Appl. No.: 10/490,069

(22) PCT Filed: Nov. 28, 2002

(86) PCT No.: PCT/GB02/05384

§ 371 (c)(1),
(2), (4) Date: Sep. 1, 2004

(87) PCT Pub. No.: WO03/063109

PCT Pub. Date: Jul. 31, 2003

(65) Prior Publication Data

US 2005/0062617 A1 Mar. 24, 2005

(30) Foreign Application Priority Data

Jan. 18, 2002 (GB) ..... 0201168.2

(51) Int. Cl.
*G08G 1/01* (2006.01)

(52) U.S. Cl. ..... 340/933; 340/936; 340/940; 340/941; 340/988

(58) Field of Classification Search ..... 340/934, 340/933, 936, 939, 940, 941, 943, 995.13, 340/988; 324/174, 179; 364/436, 438
See application file for complete search history.

(56) References Cited

U.S. PATENT DOCUMENTS 5,008,666 A * 4/1991 Gebert et al. ..... 340/936

(Continued)

FOREIGN PATENT DOCUMENTS

| | | | |
|---|---|---|---|
| DE | 3501033 | A1 | 7/1986 |
| EP | 0502803 | A1 | 9/1992 |
| WO | WO 95/14292 | A1 | 5/1995 |

OTHER PUBLICATIONS

Patents Act 1977: Search Report under Section 17 for United Kingdom Counterpart Application No. GB 0201168.2 (Aug. 13, 2002).

(Continued)

*Primary Examiner*—Hung Nguyen
(74) *Attorney, Agent, or Firm*—Blakely, Sokoloff, Taylor & Zafman LLP

(57) ABSTRACT

A method of assessing the accuracy of a roadside traffic monitoring system (TMS) arranged to measure the speed and/or other parameters of vehicles passing a predetermined measurement point adjacent the TMS is disclosed. The method includes measuring the speed of each vehicle passing the measurement point using the TMS, measuring the moment in time that each vehicle passes the measurement point using the TMS, and recording the measured speeds and times as data pairs. The method further includes driving an Instrumented Probe Vehicle (IPV) at the measurement point, the IPV having an onboard system for measuring speed, determining the location of the IPV, determining a calibration time at which the determined location of the IPV corresponds to the location of the measurement point, and measuring a calibration speed of the IPV using the onboard system when the determined location of the IPV corresponds to the location of the measurement point.

25 Claims, 3 Drawing Sheets

U.S. PATENT DOCUMENTS

| | | | | |
|---|---|---|---|---|
| 5,455,768 | A | 10/1995 | Johnson et al. | |
| 5,815,092 | A | 9/1998 | Gregg, III et al. | |
| 5,877,705 | A * | 3/1999 | Sampey | 340/933 |
| 5,998,741 | A | 12/1999 | Beshears et al. | |
| 6,011,515 | A * | 1/2000 | Radcliffe et al. | 342/453 |
| 6,208,268 | B1 * | 3/2001 | Scarzello et al. | 324/174 |
| 6,828,920 | B2 * | 12/2004 | Owen et al. | 340/941 |
| 2003/0052797 | A1 * | 3/2003 | Rock et al. | |

OTHER PUBLICATIONS

International Search Report for PCT Counterpart Application No. PCT/GB02/05384 filed Nov. 28, 2002 (Search Report mailed Feb. 14, 2003).

* cited by examiner

ASSESSING THE ACCURACY OF ROAD-SIDE SYSTEMS

CROSS-REFERENCE TO RELATED APPLICATIONS

The present application is a National Phase Application of International Application No. PCT/GB02/05384, filed Nov. 28, 2002, which claims priority from Great Britain Patent Application No. 0201168.2, filed Jan. 18, 2002. The present application claims priority from both applications.

FIELD

The present invention generally relates to the assessment of the accuracy of road-side systems, and more particularly but not exclusively to the assessment of road-side Traffic Monitoring Stations (TMS).

BACKGROUND

A highway operator often wishes to gather information about vehicles using the highway. The speeds and journey times of vehicles are particularly of interest. For example, the operator of a motorway from London to Bristol may wish to know the speed of individual vehicles at one or a number of locations. The instantaneous speeds of vehicles at predefined locations are known as "spot speeds". The operator may also wish to know the average travel time between London and Bristol, for example, or for sections of the route. This travel time can be estimated from the spot speeds measured at the measurement points. The methods to integrate the journey time from the spot speeds are well known and will not be described herein.

There are two roadside systems in general use for measuring the speed of vehicles at a particular location: One of these uses two sensors a fixed distance apart. Sensors can for example take the form of light beams arranged to be broken by passing vehicles, or electromagnetic coils or pressure sensors buried in the roadway. The time taken for a vehicle to pass from one sensor to the other is measured, and the speed of the vehicle can be calculated from this "time of flight". Roadside systems that use such a system have the problem that over time they may drift out of calibration.

Another roadside system in general use takes advantage of the Doppler effect. A radar source is directed towards oncoming traffic, and radio waves reflected back towards the source from the moving traffic are detected. The speed of a vehicle travelling towards such a radar source can be calculated from the change in frequency of the radio waves reflected from that vehicle. Such systems are unlikely to drift out of calibration over time. However, systems with Doppler radar are subject to installation and orientation errors that introduce the "cosine effect" whereby all speeds of vehicles are under-read by a certain proportion, determined by the angle of the radar beam relative to the vehicle direction.

Before the results of spot speed measurement can be used for analysis of the traffic stream, the accuracy of each measurement station needs to be assessed. Final results are not useful unless a confidence limit can be determined for the spot speed of all vehicles at each site and the average speeds for all vehicles at a selection of sites constituting a journey. Furthermore, measurement stations need to be assessed for accuracy at regular time intervals following their initial installation, to confirm that they have not drifted away from calibration. Typically, measurement stations need to be assessed approximately every three months.

The equipment and method for assessing measurement stations needs to be suitable for fast and efficient verification of speed monitoring equipment. This means that the system must be portable and suitable for quick deployment or assessment.

At present, systems for speed measurement assessment include the following methods:

Radar (Doppler) or LIDAR (Laser Diode Ranging).

Two light beams horizontally or vertically across the carriageway.

Two pressure sensors on the road surface.

Radar devices use the Doppler effect as described above. When portable devices are used, the radio source and receiver are located in a hand held device (a "speed gun"). Such devices are very accurate when used in suitable conditions, but can still give rise to a number of drawbacks. Firstly, when a motorist sees a speed gun in use, they will often apply the brakes, or at least take their foot off the accelerator. This means that the vehicle will be slowing as it passes the sensor and this will introduce a measurement error. Furthermore, the method is very labour-intensive and difficult to use in heavy traffic. There are errors introduced by the "cosine" effect, the effect of the angle between the gun beam and the vehicle direction.

Two horizontal light beams or pressure sensors on the road surface may be used successfully in low volume single lane carriageways. However, many modern roads are dense dual carriageways, and these methods are impractical in practice. Installing sensors on the road is hazardous and can easily lead to an accident.

Thus the present methods for assessing the accuracy of road-side measurement are relatively inefficient, inaccurate and can be unsafe to use.

SUMMARY

In accordance with a first aspect of the present invention there is provided apparatus for assessing the accuracy of a roadside traffic monitoring station (MS) having data measurement means for measuring a parameter of vehicles passing a predetermined measurement point and the moment in time at which each vehicle passes the measurement point, the apparatus comprising:

data recording means for recording the parameter of each vehicle and moment in time that vehicle passes the measurement point as measured by the data measurement means;

an Instrumented Probe Vehicle (IPV) having an onboard measuring system for measuring the parameter of the IPV;

locating means associated with the IPV for determining the location of the IPV independently of the TMS;

timing means for determining the moment in time at which the location of the IPV as measured by the locating means corresponds to the location of the measurement point; and data processing means for identifying the parameter of the IPV as measured by the parameter measurement means from the moment in time at which the IPV passes the measurement point.

This means that the TMS can be assessed for accuracy by comparing the parameter of the IPV as measured by the TMS with the parameter of the IPV as known beforehand or determined by the IPV onboard measurement system. The measured parameter may be one or more of speed, vehicle length, width, height, gross weight, axle weight, and wheel configuration. This allows the accuracy of the TMS to be assessed easily by driving an IPV connected to suitable locating means past the TMS, requiring very little operator skill. Since no road-side operations are required, the safety of personnel carrying out the assessment is increased. There is little or no disruption or disturbance of the vehicle stream.

The locating and/or timing means may conveniently include a Global Positioning System (GPS).

The apparatus preferably comprises a communication system so that data can pass from the IPV to the data processing means, the data processing means being arranged to receive data from the IPV corresponding to the time at which the location of the IPV corresponds to the location of the measurement point, and to identify a data pair in the data recording means corresponding to that time, said data pair including the parameter of the IPV as measured by the TMS. The IPV may include means for recording the parameter at the moment in time at which the IPV is located at the measurement point and transmitting this information to the data processing system.

The communication means preferably includes a mobile phone system, enabling the IPV to send data to the data processing means as a Short Message Service (SMS) message.

The parameter may be speed, and the IPV preferably includes onboard speed measurement and recording means for measuring and recording the speed at the moment in time at which the IPV is located at the measurement point.

In accordance with a second aspect of the present invention there is provided apparatus for assessing the accuracy of a roadside traffic monitoring station (TMS) having data determination means for determining the measured speed of vehicles passing a measurement location and the measured moment in time at which each vehicle passes the measurement location, the apparatus comprising:

an Instrumented Probe Vehicle (IPV) having on board speed measuring means for measuring the speed of the IPV;

locating means for determining the location of the IPV independently of the TMS; and recording means for recording a calibration speed of the IPV as measured by the on board speed measuring means when the IPV is located at the measurement location as determined by the locating means, together with a calibration time at which the IPV is located at the measurement location.

The apparatus preferably comprises communication means for communicating the calibration speed and calibration time of the IPV to the TMS, and may include data processing means for comparing the calibration time received from the IPV with the measured times of vehicles passing the measurement location so as identify the measured speed of the IPV and compare it with the calibration speed.

Similar apparatus may be used to assess the accuracy of a TMS arranged to measure the weight of passing vehicles instead of or in addition to their speed. The IPV may include a dynamic weight determination means enabling a calibration weight to be determined when the IPV is located at the measurement point.

In accordance with a third aspect of the present invention there is provided a method of assessing the accuracy of a roadside traffic monitoring station (TMS) arranged to measure a parameter of vehicles passing a predetermined measurement point, the method comprising:

measuring the parameter of each vehicle passing the measurement point using the TMS;

measuring the moment in time that each vehicle passes the measurement point using the TMS;

recording the measured parameters and times as data pairs;

driving an Instrumented Probe Vehicle (IPV) past the measurement point, the IPV arranged so that the parameter thereof is known or is measurable using an onboard measuring system;

determining the location of the IPV using location means;

determining the time at which the determined location of the IPV corresponds to the location of the measurement point;

sending the determined time, and the parameter of the IPV as known or measured using the on board system, to the TMS;

identifying the recorded data pair corresponding to the determined time;

identifying the parameter of the IPV, as measured by the TMS, from said identified data pair; and comparing the parameter of the IPV, as measured by the TMS, with the parameter of the IPV, as known or measured by the onboard measuring system.

The parameter may be vehicle speed, and the speed of the IPV is preferably measured using an onboard system and recorded at the moment the location of the IPV, as determined by the location means, corresponds to the measurement point.

The method preferably further comprises driving the IPV past a plurality of measurement points and comparing the parameter of the IPV, as known or measured by an onboard measuring system, with the parameter of the IPV as measured at each measurement point.

In accordance with a fourth aspect of the present invention there is provided a method of assessing the accuracy of a roadside traffic monitoring station (TMS) arranged to measure the speed of vehicles passing a predetermined measurement point, the method comprising:

measuring the speed of each vehicle passing the measurement point using the TMS;

measuring the moment in time that each vehicle passes the measurement point using the TMS;

recording the measured speeds and times as data pairs;

driving an Instrumented Probe Vehicle (IPV) past the measurement point, the IPV having an onboard system for measuring speed;

determining the location of the IPV using location means;

determining a calibration time at which the determined location of the IPV corresponds to the location of the measurement point;

measuring a calibration speed of the IPV using the onboard system when the determined location of the IPV corresponds to the location of the measurement point;

sending the calibration time and calibration speed to the TMS;

identifying the recorded data pair corresponding to the calibration time;

identifying the speed of the IPV, as measured by the TMS, from said identified data pair; and comparing the speed of the IPV, as measured by the TMS, with the calibration speed of the IPV, as measured by the onboard measuring system.

A similar method may be used to assess the accuracy of a "weigh-in-motion" system, although in such a case the IPV may not need onboard weight measuring means. The weight of the IPV can be determined before it is driven past the measurement point. However, for more accurate assessment the IPV may be fitted with an onboard dynamic weighing system (well known in prior art) which reports the instantaneous wheel loads continuously. As with the speed measurement, these wheel loads may be captured at the appropriate moment as the IPV passes the measurement point and sent to the TMS with the calibration time at which the IPV passes the measurement point. In that way the dynamic effect of undulations in the road surface which lead to vehicle bounce and thus a dynamic element in the vehicle load on the road can be isolated.

The IPV may be a maintenance or operations vehicle. Such vehicles may be used on the section of highway on which the traffic monitoring stations are located to monitor the condition of the highway. This has the advantage of reducing costs, as roadside systems can be calibrated using vehicles which would be passing the stations in any case.

In accordance with a fifth aspect of the present invention there is provided a computer storage medium having stored thereon a program arranged when executed to enable a processor to:

receive data containing matched record pairs corresponding to a parameter of a vehicle passing a TMS together with the time at which said vehicle passes said TMS, each as measured by the TMS;

receive data from an IPV containing information about the parameter of the IPV, together with the time at which the IPV passes the TMS, each as determined by an onboard measurement system of the IPV;

identify which matched record pair corresponds to the passage of the IPV by comparing the time at which the IPV passes the TMS as determined by the on board measurement system with the time at which vehicles pass the TMS as measured by the TMS; and determine the parameter of the IPV as measured by the TMS from the identified matched record pair.

The program is preferably further arranged to enable the processor to compare the parameter of the IPV as measured by the TMS with the parameter of the IPV as measured by the onboard measurement system so as to determined the measurement accuracy of the TMS.

BRIEF DESCRIPTION OF THE DRAWINGS

Some preferred embodiments of the invention will now be described by way of example only and with reference to the accompanying drawings, in which.

DETAILED DESCRIPTION

Figure 1:
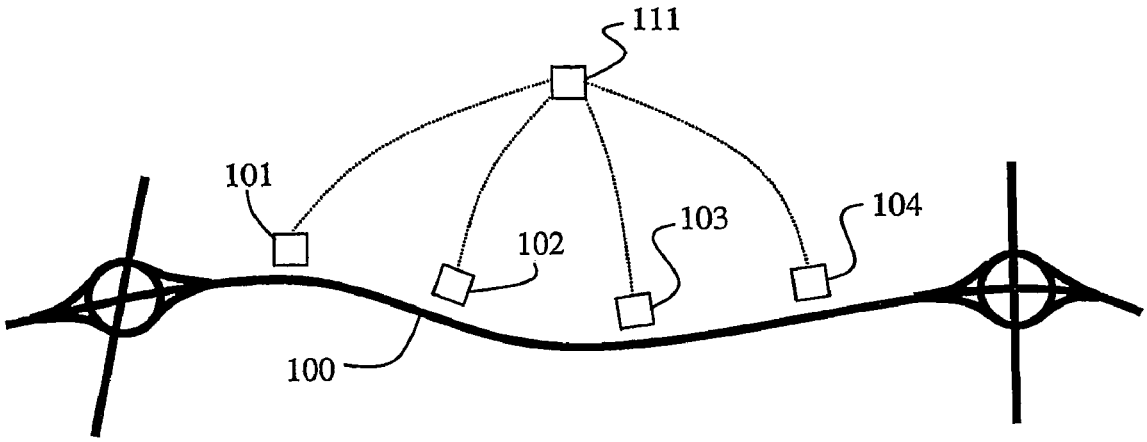
FIG. 1 is a schematic diagram showing the general layout of a section of highway.

FIG. 1 is a schematic diagram showing the general layout of a section of highway 100 having four traffic measurement stations 101, 102, 103 and 104. In this example, the stations are installed at 500 metre intervals. Each measurement station is arranged to measure the speed of vehicles passing the measurement station and transmit this information to a central location, or instation, 111. The time of journey for vehicles travelling along the highway can be estimated from the speeds of vehicles passing the four measuring stations.

Figure 2:
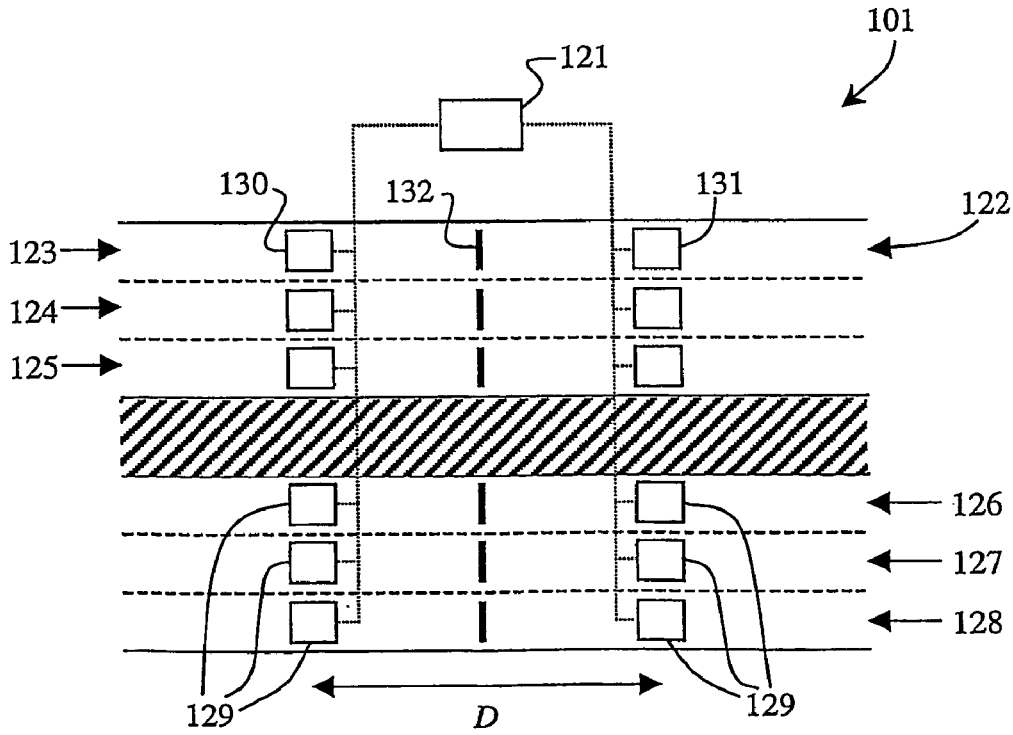
FIG. 2 shows the components of a traffic monitoring station (TMS)

FIG. 2 shows the components of an individual measurement station 101, arranged to measure the speeds of vehicles in both carriageways of a motorway 122, i.e. six lanes of traffic 123, 124, 125, 126, 127, 128. The measurement station comprises wire loops 129 located under the surface of the roadway 122, two loops being located under each lane of traffic a fixed distance D apart. The following discussion will consider the two loops 130, 131 located in the first lane of traffic 123, but it will be appreciated that the same considerations will apply for all of the other lanes.

Each loop 130, 131 is about two metres square and consists of 3 turns of wire. As a vehicle passes over the loop it causes a change in the inductance of the loop, and this can be detected by "loop detectors" (not shown) attached to the loop. The loop detectors are connected to a measurement and control unit 121 which includes processing means for analysing information passed to the measurement and control unit by the loop detectors. The loop detectors can be arranged to provide an analogue representation of the passing of each vehicle, or alternatively can be set to be switched "on" or "off" by the passage of a vehicle. Every time a vehicle is detected by a loop detector this information is passed to the measurement and control unit 121. The speed of a vehicle passing the loops 130, 131 is determined by the measurement and control unit 121 from the time it takes between detection by the two loops. This gives the time for the vehicle to travel the fixed distance D, and thus its speed over that distance.

Figure 3:
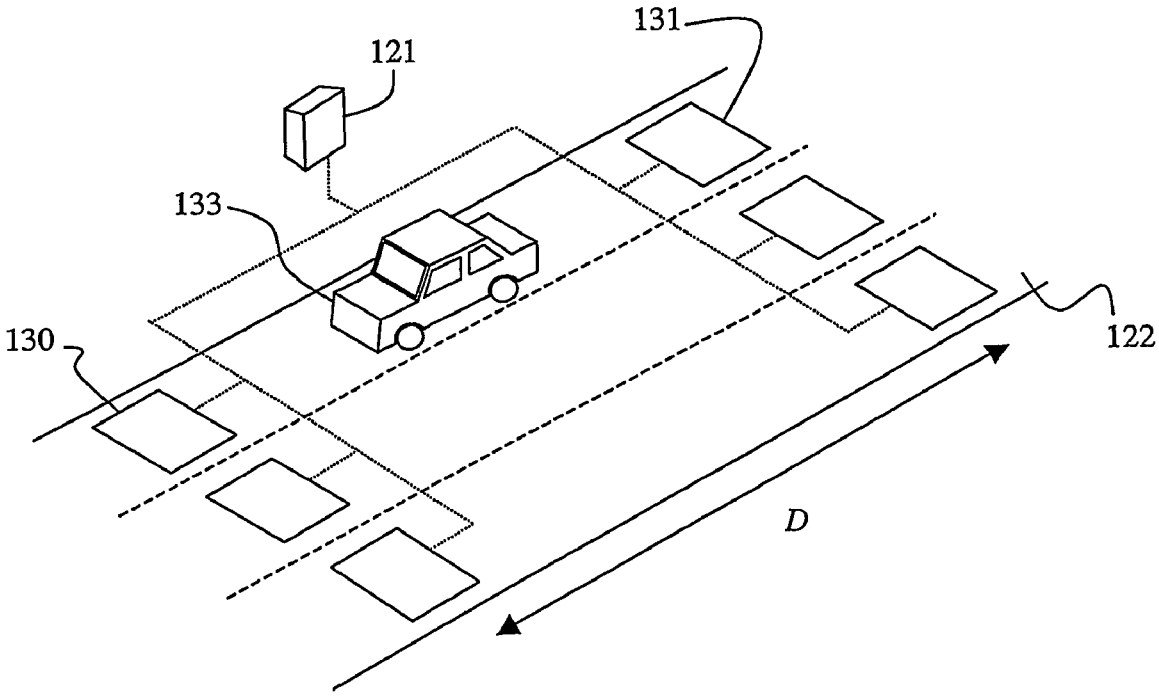
FIG. 3 is a perspective view of part of a TMS.

The point in the lane half way between the two loops is known as the "measurement location" 132 for that measurement station. Each lane will have its own measurement location, so that the measurement station 101 has associated with it six measurement locations. FIG. 3 shows a perspective view of one carriageway of the motorway 122 at the measurement station 101, at the moment that a car 133 crosses the measurement point 132 for the first lane 122. The measurement and control unit 121 passes information about the speed of each vehicle which passes each measurement point, and the moment in time when this takes place, back to the central instation 111 (see FIG. 1) which is arranged to correlate information from all of the measurement stations. In practice, loop sensors and other sensors and/or detectors may have a number of further distinct detection points at which a passing vehicle can be detected and its speed measured whilst the vehicle is in a sensing area or at a sensing point. The entire system of detectors involved in the roadside processing is known as a traffic monitoring system (TMS).

Figure 4:
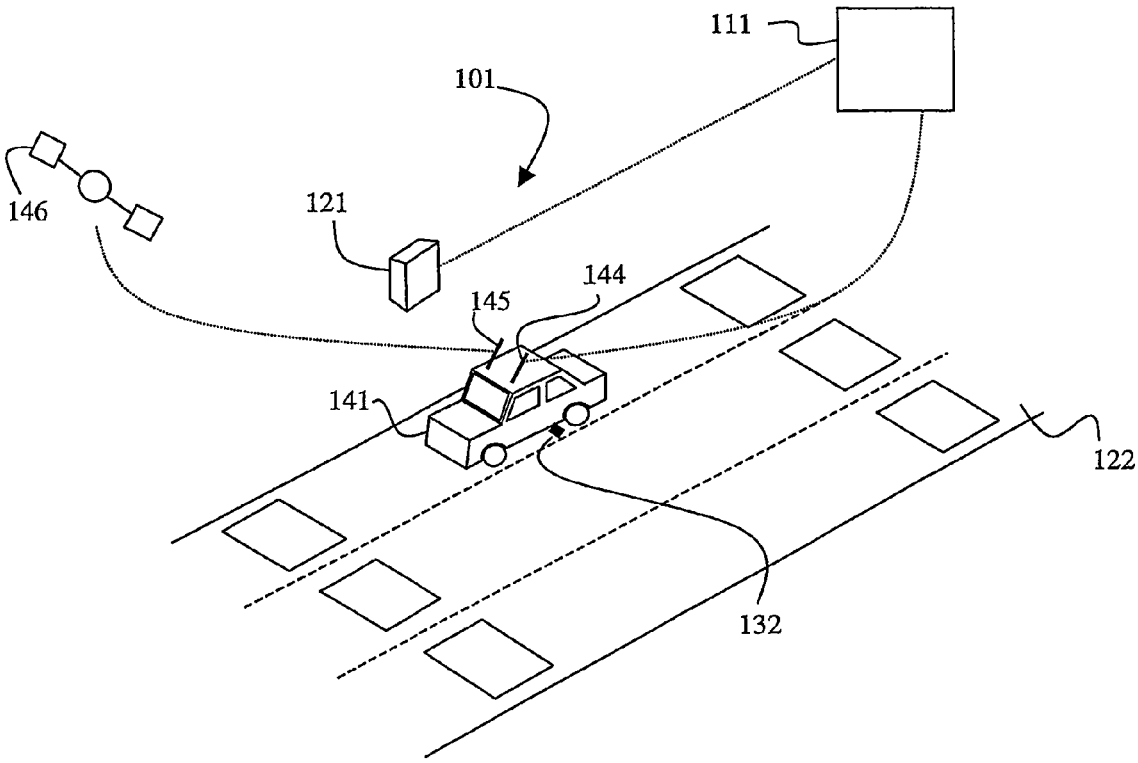
FIG. 4 shows the components used to match Instrumented Probe Vehicle (IPV) measurements with TMS measurements.

FIG. 4 shows a general overview of the system used to check the accuracy of the TMS. An instrumented probe vehicle (IPV) 141 is fitted with a custom speed monitoring and control system that enables its speed to be measured to ±0.3 mph (at a 95% confidence level). The IPV is also fitted with a transmitter and receiver device 145 which allows it to connect to an accurate locating system such as the Global Positioning System (GPS) 146. The IPV 141 is also fitted with an on-board computer, into which is programmed the exact position of the measurement point of each lane of each TMS.

The IPV is driven past each of the measurement stations. As the vehicle is in motion, it continually calculates the position of the nearest TMS 101 and lane locations. As the IPV approaches a TMS location 101, once it is within a certain minimum distance, it monitors its position and at the very point where the change in the distance to the nearest measurement point 132 is zero, it calculates it own precise speed and direction. This value is transferred to a temporary storage position together with the exact time (HH:MM:SS.TTTT) also derived from the GPS signal and an indication of the measurement point 132 passed, and the location of the TMS 101.

This data is then assembled as a Short Message Service (SMS) data message and sent via a transmitter 144 to the address of the central instation 111. The instation 111 interrogates the control and measurement unit 121 of the specified TMS 101 and from the time and location information the IPV is identified from the record of the passage of individual vehicles held at the TMS 101.

In other words, as the IPV 141 is driven past the measurement station 101, its speed is measured both by the onboard system of the IPV itself and by the measurement station 101. By using GPS to determine the exact time at which the IPV passes the station, the two records can be matched. In practice, the process gathers matched records over one or more days of operations, and an average result is obtained. Typically, for statistical significance, when a normal distribution is known, about 6 minimum samples are required.

This accuracy assessment is conducted at periodic intervals, typically every three months (i.e. four times per year) for all of the TMS measurement points maintained by a highway operator. Starting at the first measurement station, an IPV passes all the TMS sites on a circuit. The driver proceeds with the traffic stream, but not above the speed limit. For each site, the speed as measured by the IPV is sent to the central instation 111 and matched with a corresponding record from the TMS, as described above. The round trip might take from 20 minutes to a few hours including rest breaks. In the survey period, the vehicle should make a minimum of six passes through each lane measurement point. The IPV thus obtains a minimum of 6 samples for each lane at each site. The IPV and TMS records are then analysed at the instation 111 for mean error and standard deviation.

The following example illustrates analysis applied to data derived from six vehicle passes at a single measurement point on a test track.

| Vehicle pass | IPV Speed Report (km/hr) | TMS Speed Report (km/hr) | Absolute Error (km/hr) | Error (%) |
|---|---|---|---|---|
| 1 | 147.2 | 147.5 | +0.3 | 0.20% |
| 2 | 95.7 | 95.5 | −0.2 | −0.21% |
| 3 | 101.0 | 101.5 | +0.5 | 0.50% |
| 4 | 97.3 | 97.5 | +0.2 | 0.21% |
| 5 | 147.9 | 147.5 | −0.4 | −0.27% |
| 6 | 95.5 | 95.5 | +0.0 | 0.00% |
| Average | | Mean | 0.13 | 0.20% |
| | | SD | 0.39 | 0.60% |

The TMS output in this case is shown to 0.1 km/hr during verification. This enables minimum error due to rounding when performing the error survey.

The statistics for the percentage error column are calculated: the mean speed error for the survey was 0.20% while the standard deviation (SD) was 0.60%.

From this the average error for all vehicles can be calculated using Student's t from the standard statistical tables for six samples:

$$CI(\text{Average})_{95\%} = \pm t_{95,n} \times \frac{SD}{\sqrt{n}} = 2.57 \times \frac{0.60\%}{\sqrt{6}} = \pm 0.63\%$$

Thus the true mean speed for all vehicles will be between +0.20%−0.63% and +0.20%+0.63%, i.e. between −0.43% and +0.83%, of the mean speed, calculated from the equipment reports with a confidence level of 95%. Since these values are within ±1%, the station is verified to meet the performance requirement.

To calculate the individual vehicle speed variation:

$$CI(\text{Individual})_{95\%} = \pm t_{95,n} \times SD = 2.57 \times 0.602\% = \pm 1.57\%$$

This means that individual speed reports will lie between +0.20%−1.57% and +0.20%+1.57%, i.e. −1.37% and +1.77% at a confidence level of 95%. Since these values are within ±2%, the station is verified to meet the performance requirement.

Thus a reliable estimate of the performance of the TMS has been gained giving data on the measurement of individual vehicles, the way this extrapolates to the mean speed of all vehicles, and systematic bias. This information has been gathered in a safer and more accurate method and at lower cost than the existing methods.

The above description refers to the calibration of speed measurement systems designed to be used in lanes of traffic. Sometimes such speed measurement systems also have measurement points in the "hard shoulder" of a motorway. For safety reasons, hard shoulder verification is not normally performed. If hard shoulder verification is required, the hard shoulder passes should be at "hard shoulder speeds", i.e. around half normal flow speed. The test would be abandoned if any abnormality in traffic flow is observed or if the hard shoulder is occupied within a kilometre of the TMS. If the hard shoulder were being used as a running lane at the time of verification, it would be verified at that time, although the closed lane would not be verified on that occasion.

The calibration systems and methods described above provide higher levels of accuracy than were possible with previous apparatus and methods. Since no road-side operations are required, the safety of personnel carrying out the assessment is increased. There is little or no disruption or disturbance of the vehicle stream, and the performance of the TMSs can be checked at any time. When a high density of stations is involved, the time per test can be as little at 10–30 seconds with little or no operator experience. The audit records created are impossible for the test operator to influence or corrupt in any way.

It may be possible to reduce costs even further if the IPV is a dual purpose vehicle used normally for maintenance on the section of road along which the TMS devices are located. It is usual for maintenance vehicles to make three or four runs along the highway each day to check for debris and broken down vehicles, check the condition of signposts and the surface of the road, etc. In such a case the necessary components for recording and forwarding times and speeds can be installed in the maintenance vehicle and left running permanently, enabling almost continuous assessments of the performance of the TMS devices.

It will be appreciated that the invention is not limited to the embodiment described above, and may also be used for calibration of other equipment. For example, an IPV of known weight could be used to assess the accuracy of "weigh-in-motion" systems which determine the weight of vehicles crossing them. Such systems require frequent recalibration to remain inside specified limits. Weight sensors for such systems are also sometimes attached to TMS devices. By determining the exact position of the IPV at all times using GPS or similar, and knowing the exact position of the weight sensor, the exact moment in time at which it crosses (and is weighed by) a weigh-in-motion sensor point can be determined. This information can be sent to the weigh-in-motion system together with the known weight of the IPV, enabling the record corresponding to the IPV to be extracted from the weigh-in-motion system records and compared with this known weight. A similar system may be used to calibrate measurement systems for vehicle length, width, height, gross weight, axle weight, or wheel configuration, for example.

It will be appreciated that other departures from the embodiments described above may stall fall within the scope of the invention.

What is claimed is:

1. Apparatus for assessing the accuracy of a roadside traffic monitoring station having data measurement means for measuring a parameter of vehicles passing a predetermined measurement point and the moment in time at which each vehicle passes the measurement point, the apparatus comprising:

data recording means for recording the parameter of each vehicle and moment in time that vehicle passes the measurement point as measured by the data measurement means;

an Instrumented Probe Vehicle having an onboard measuring system for measuring the parameter of the Instrumented Probe Vehicle;

locating means associated with the Instrumented Probe Vehicle for determining the location of the IPV independently of the traffic monitoring station;

timing means for determining the moment in time at which the location of the Instrumented Probe Vehicle as measured by the locating means corresponds to the location of the measurement point; and data processing means for identifying the parameter of the Instrumented Probe Vehicle as measured by the data measurement means from the moment in time at which the Instrumented Probe Vehicle passes the measurement point.

2. Apparatus as claimed in claim 1, wherein the locating means includes a Global Positioning System.

3. Apparatus as claimed in claim 1, wherein the timing means includes a Global Positioning System.

4. Apparatus as claimed in claim 1 and comprising a communication system for passing data from the Instrumented Probe Vehicle to the data processing means, so that the data processing means can receive data from the Instrumented Probe Vehicle corresponding to the time at which the location of the Instrumented Probe Vehicle as measured by the locating means corresponds to the location of the measurement point, and can identify a data pair in the data recording means corresponding to that time, said data pair including the parameter of the Instrumented Probe Vehicle as measured by the traffic monitoring station.

5. Apparatus as claimed in claim 4, wherein the Instrumented Probe Vehicle includes means for recording the parameter as measured by the onboard measuring system at the moment in time at which the Instrumented Probe Vehicle is located at the measurement point as determined by the locating means, and transmitting this information to the data processing means.

6. Apparatus as claimed in claim 5, wherein the communication system includes a mobile phone system.

7. Apparatus as claimed in claim 6, wherein the Instrumented Probe Vehicle is arranged to send data to the data processing means as a Short Message Service message.

8. Apparatus as claimed in claim 1, wherein the parameter is speed and the Instrumented Probe Vehicle includes onboard speed measurement and recording means for measuring and recording the speed at the moment in time at which the Instrumented Probe Vehicle is located at the measurement point.

9. Apparatus as claimed in claim 1, wherein the parameter is vehicle length, width, height, gross weight, axle weight, or wheel configuration.

10. Apparatus for assessing the accuracy of a roadside traffic monitoring station having data determination means for determining the measured speed of vehicles passing a measurement location and the measured moment in time at which each vehicle passes the measurement location, the apparatus comprising:

an Instrumented Probe Vehicle having on board speed measuring means for measuring the speed of the Instrumented Probe Vehicle;

locating means associated with the Instrumented Probe Vehicle for determining the location of the Instrumented Probe Vehicle independently of the traffic monitoring station; and recording means for recording a calibration speed of the Instrumented Probe Vehicle as measured by the on board speed measuring means when the location of the Instrumented Probe Vehicle as determined by the locating means corresponds to the measurement location, together with a calibration time at which the Instrumented Probe Vehicle is located at the measurement location as determined by the locating means.

11. Apparatus as claimed in claim 10, further comprising communication means for communicating the calibration speed and calibration time of the IPV to the traffic monitoring station.

12. Apparatus as claimed in claim 11, further comprising data processing means for comparing the calibration time received from the Instrumented Probe Vehicle with the measured times of vehicles passing the measurement location so as identify the measured speed of the Instrumented Probe Vehicle and compare it with the calibration speed.

13. Apparatus for assessing the accuracy of a roadside traffic monitoring station having data determination means for determining the measured weight of vehicles passing a measurement location and the measured moment in time at which each vehicle passes the measurement location, the apparatus comprising:

an Instrumented Probe Vehicle having a known weight;

locating means associated with the Instrumented Probe Vehicle for determining the location of Instrumented Probe Vehicle independently of the traffic monitoring station; and recording means arranged to record a calibration time at which the location of the Instrumented Probe Vehicle as determined by the locating means corresponds to the measurement location.

14. Apparatus as claimed in claim 13, wherein the Instrumented Probe Vehicle is fitted with an onboard dynamic weighing system which reports instantaneous wheel loads so as to determine the weight of the vehicle, and wherein the recording means is arranged to record a calibration weight of the Instrumented Probe Vehicle as determined by the on board weighing system at the moment in time the Instrumented Probe Vehicle is located at the measurement location, together with the calibration time at which the Instrumented Probe Vehicle is located at the measurement location.

15. Apparatus as claimed in claim 13, wherein the Instrumented Probe Vehicle is a maintenance or operations vehicle.

16. A method of assessing the accuracy of a roadside traffic monitoring station arranged to measure a parameter of vehicles passing a predetermined measurement point, the method comprising:

measuring the parameter of each vehicle passing the measurement point using the traffic monitoring station;

measuring the moment in time that each vehicle passes the measurement point using the traffic monitoring station;

recording the measured parameters and times as data pairs;

driving an Instrumented Probe Vehicle past the measurement point, the IPV arranged so that the parameter thereof is known or is measurable using an onboard measuring system;

determining the location of the Instrumented Probe Vehicle using location means;

determining the time at which the determined location of the Instrumented Probe Vehicle corresponds to the location of the measurement point;

sending the determined time, and the parameter of the Instrumented Probe Vehicle as known or measured using the on board system, to the traffic monitoring station;

identifying the recorded data pair corresponding to the determined time;

identifying the parameter of the Instrumented Probe Vehicle, as measured by the traffic monitoring station, from said identified data pair; and comparing the parameter of the Instrumented Probe Vehicle, as measured by the traffic monitoring station, with the parameter of the Instrumented Probe Vehicle, as known or measured by the onboard measuring system.

17. A method as claimed in claim 16, wherein the location means includes a Global Positioning System.

18. A method as claimed in claim 16, wherein the parameter is vehicle speed, and wherein the speed of the Instrumented Probe Vehicle is measured using an onboard system and recorded at the moment the location of the Instrumented Probe Vehicle, as determined by the location means, corresponds to the measurement point.

19. A method as claimed in claim 16, further comprising driving the Instrumented Probe Vehicle past a plurality of measurement points and comparing the parameter of the Instrumented Probe Vehicle, as known or measured by an onboard measuring system, at each measurement point, with the parameter of the Instrumented Probe Vehicle as measured using the traffic monitoring station at that measurement point.

20. A method of assessing the accuracy of a roadside traffic monitoring station arranged to measure the speed of vehicles passing a predetermined measurement point, the method comprising:

measuring the speed of each vehicle passing the measurement point using the traffic monitoring station;

measuring the moment in time that each vehicle passes the measurement point using the traffic monitoring station;

recording the measured speeds and times as data pairs;

driving an Instrumented Probe Vehicle past the measurement point, the IPV having an onboard system for measuring speed;

determining the location of the Instrumented Probe Vehicle using location means;

determining a calibration time at which the determined location of the Instrumented Probe Vehicle corresponds to the location of the measurement point;

measuring a calibration speed of the Instrumented Probe Vehicle using the onboard system when the determined location of the Instrumented Probe Vehicle corresponds to the location of the measurement point;

sending the calibration time and calibration speed to the traffic monitoring station;

identifying the recorded data pair corresponding to the calibration time;

identifying the speed of the Instrumented Probe Vehicle, as measured by the traffic monitoring station, from said identified data pair; and comparing the speed of the Instrumented Probe Vehicle, as measured by the traffic monitoring station, with the calibration speed of the Instrumented Probe Vehicle, as measured by the onboard measuring system.

21. A method of assessing the accuracy of a roadside traffic monitoring station arranged to measure the weight of vehicles passing a predetermined measurement point, the method comprising:

measuring the weight of each vehicle passing the measurement point using the traffic monitoring station;

measuring the moment in time that each vehicle passes the measurement point using the traffic monitoring station;

recording the measured weights and times as data pairs;

determining a calibration weight of an Instrumented Probe Vehicle using a weight determination means associated with the Instrumented Probe Vehicle;

driving the Instrumented Probe Vehicle past the measurement point;

determining the location of the Instrumented Probe Vehicle using location means;

determining a calibration time at which the determined location of the Instrumented Probe Vehicle corresponds to the location of the measurement point;

sending the calibration time and calibration weight to the traffic monitoring station;

identifying the recorded data pair corresponding to the calibration time;

identifying the weight of the Instrumented Probe Vehicle, as measured by the traffic monitoring station, from said identified data pair; and comparing the weight of the Instrumented Probe Vehicle, as measured by the traffic monitoring station, with the calibration weight of the Instrumented Probe Vehicle, as determined by the weight determination means.

22. A method as claimed in claim 21, wherein the weight determination means is an onboard dynamic weighing system which reports instantaneous wheel loads so as to determine the weight of the vehicle, and wherein the calibration weight is determined when the Instrumented Probe Vehicle is located at the measurement point.

23. A method as claimed in of claim 16, wherein the Instrumented Probe Vehicle is a maintenance or operations vehicle.

24. A computer storage medium having stored thereon a program arranged when executed to enable a processor to:

receive data containing matched record pairs corresponding to a parameter of a vehicle passing a traffic monitoring station together with the time at which said vehicle passes said traffic monitoring station, each as measured by the traffic monitoring station;

receive data from an Instrumented Probe Vehicle containing information about the parameter of the Instrumented Probe Vehicle, together with the time at which the Instrumented Probe Vehicle passes the traffic monitoring station, each as determined by an onboard measurement system of the Instrumented Probe Vehicle;

identify which matched record pair corresponds to the passage of the Instrumented Probe Vehicle by comparing the time at which the IPV passes the traffic monitoring station as determined by the on board measurement system with the time at which vehicles pass the traffic monitoring station as measured by the traffic monitoring station; and determine the parameter of the Instrumented Probe Vehicle as measured by the traffic monitoring station from the identified matched record pair.

25. A computer storage medium as claimed in claim 24, wherein the program is further arranged to enable the processor to compare the parameter of the Instrumented Probe Vehicle as measured by the traffic monitoring station with the parameter of the Instrumented Probe Vehicle as measured by the onboard measurement system so as to determined the measurement accuracy of the traffic monitoring station.

* * * * *